United States Patent [19]

Bernard et al.

[11] Patent Number: 4,803,319

[45] Date of Patent: Feb. 7, 1989

[54] ROTARY SWITCH WITH CURVED ARC ROOT MIGRATION TRACK

[75] Inventors: Georges Bernard, St. Egreve; Bernard Bouvet, Echirolles; Richard Jacolin, Voiron; Guido Colleoni, Bergamo; Jacques Gaillard, Grenoble; Robert Volsy, Tullins, all of France

[73] Assignee: Merlin Gerin, Grenoble, France

[21] Appl. No.: 206,310

[22] Filed: Jun. 14, 1988

[30] Foreign Application Priority Data

Jun. 25, 1987 [FR] France ..... 87 09009

[51] Int. Cl.[4] ..... H01H 33/18; H01H 33/60

[52] U.S. Cl. ..... 200/147 A; 200/147 R; 200/148 H; 200/148 B

[58] Field of Search ..... 200/147 A, 147 R, 148 H, 200/148 B

[56] References Cited

U.S. PATENT DOCUMENTS

| | | | |
|---|---|---|---|
| 2,611,059 | 9/1952 | Immel et al. | 200/147 A |
| 3,064,104 | 11/1962 | Wells et al. | 200/147 A |
| 3,194,918 | 7/1965 | Muscante et al. | 200/147 R |
| 3,646,284 | 2/1972 | Bokshorn et al. | 200/148 H |
| 4,357,508 | 11/1982 | Werner | 200/148 H |
| 4,700,028 | 10/1987 | Heyde | 200/148 H |

FOREIGN PATENT DOCUMENTS

| | | | |
|---|---|---|---|
| 658851 | 5/1965 | Belgium . | |
| 612712 | 5/1935 | Fed. Rep. of Germany | 200/148 H |
| 1199363 | 8/1965 | Fed. Rep. of Germany . | |
| 2254871 | 7/1975 | France . | |

*Primary Examiner*—Robert S. Macon

*Attorney, Agent, or Firm*—Parkhurst, Oliff & Berridge

[57] ABSTRACT

A rotary switch with a sealed enclosure in which a rotating knife-blade is housed cooperating with two stationary contacts supported by the internal periphery of the enclosure. A permanent magnet is incorporated in the stationary contacts to magnetically blow the arc roots on a curved migration track towards hidden locations which are not facing the knife-blade.

The invention is applicable to a gas-insulated medium voltage switch.

10 Claims, 6 Drawing Sheets

ROTARY SWITCH WITH CURVED ARC ROOT MIGRATION TRACK

BACKGROUND OF THE INVENTION

The invention relates to a medium voltage rotary switch with a sealed enclosure, whose internal periphery bears two diametrically opposed stationary contacts, each stationary contact being capable of cooperating with a movable contact of a contact bridge to form a pair of contacts, said contact bridge, in the form of a pivoting knife-blade, being borne by a rotating operating shaft, which can selectively occupy a closed position in which the two pairs of contacts are closed and an open position.

A state-of-the-art rotary switch of the kind mentioned comprises internal gas compression compartments enabling pneumatic blowout of the arc which favors its extinction. These pneumatic blowout devices are complicated and require a notably increased switch operating effort.

The object of the invention is to achieve a simplified rotary switch whose breaking capacity is increased without notable modification to the device.

SUMMARY OF THE INVENTION

The rotary switch according to the present invention is characterized in that at least one of the contacts of said pairs comprises a migration track of the root of an arc, drawn when the pair of contacts opens, that this track extends in the opposite direction from the other contact of the pair, to allow the arc root and the associated hot spot to move to a hidden location where the two hot spots associated with the two arc roots are not facing one another, and that a permanent magnet, securedly fixed to the migration track contact, is arranged to blow the arc root towards said hidden location to favor arc extinction and current breaking.

In medium voltage switches, natural extinction of the arc when the current passes zero is used to perform breaking preventing refiring of the arc. To limit the risks of arc refiring after the current has passed zero, some switches comprise magnetic arc blow-out devices, notably by permanent magnets imposing rotation of the arc. Rotation of the arc and its roots reduces the heat rise and ionization of the insulating gas as well as the presence of hot spots on the contacts, capable of emitting electrons by thermoelectronic emission. The switch according to the present invention also makes use of a permanent magnet blowing out the arc root magnetically, but the breaking principle is different since it is based on the observation that an important element for non-refiring after the current passes zero is avoiding that the two hot spots on the two contacts are facing one another. By moving at least one of the arc roots to a hidden location, notably on the rear part of the contact away from the other contact, it is possible to avoid electron emission in the contact separation area.

The rotary knife-blade switch may comprise two breaks in series and the inventive arc root migration system may be associated with both of said breaks or with only one of them. The arc migration track contact having a hidden hot spot may be the movable contact, or the stationary contact, or both, and the permanent magnet is advantageously housed inside the contact in the form of a stud, notably cylindrical in shape. The axis of the cylindrical contact stud or studs is perpendicular to the movement plane of the knife-blade, and the arc root migration track is formed by the external periphery of the contact stud, this periphery being able to be the cylindrical surface of the stud or the periphery of one or more lateral sections of the stud. Movement of the arc can be guided onto the migration track by covering the adjacent parts of the contact stud with an insulating coating. The arc root and associated hot spot move according to a curved trajectory and it is clear that when the root reaches the hidden location, diametrically opposed on the cylindrical stud to the arc firing point, this hidden location is masked by the contact stud with respect to the other contact. Rotation of the knife-blade in a predetermined direction can be used to introduce a dissymmetry which favors one of the arc root rotation directions. The rotation direction is determined by the polarity of the permanent magnet and by the direction of the current at the given moment. During one of the current half-waves, the root moves on the migration track in a given direction, which is automatically reversed on the following half-wave. It will become clearer from the detailed description which follows that the choice of this rotation direction can be used to enhance either the speed with which the arc is extinguished, or the breaking capacity of the switch. The invention is applicable to any type of contact, notably to abutting contacts or to the grip contacts more particularly described hereinafter. The switch may be of the multipole type with an enclosure common to all the poles or with individual enclosures. The enclosure insulating and filling gas is a high dielectric strength gas such as sulphur hexafluoride at atmospheric pressure or compressed. The enclosure can be made of insulating or conducting material and the operating mechanism can be incorporated or be disposed outside this enclosure.

According to a further development of the invention, the arc root migration track is capped by a cover in the hidden location area to limit propagation of the electrons emitted in this area. This cover determines, with the migration track, an arc penetration corridor confining the ionized gases and the metal vapors.

BRIEF DESCRIPTION OF THE DRAWINGS

Other advantages and features will become more clearly apparent from the following description of various illustrative embodiments of the invention, given as non-restrictive examples only and represented in the accompanying drawings, in which.

DESCRIPTION OF THE PREFERRED EMBODIMENT

Figure 1:
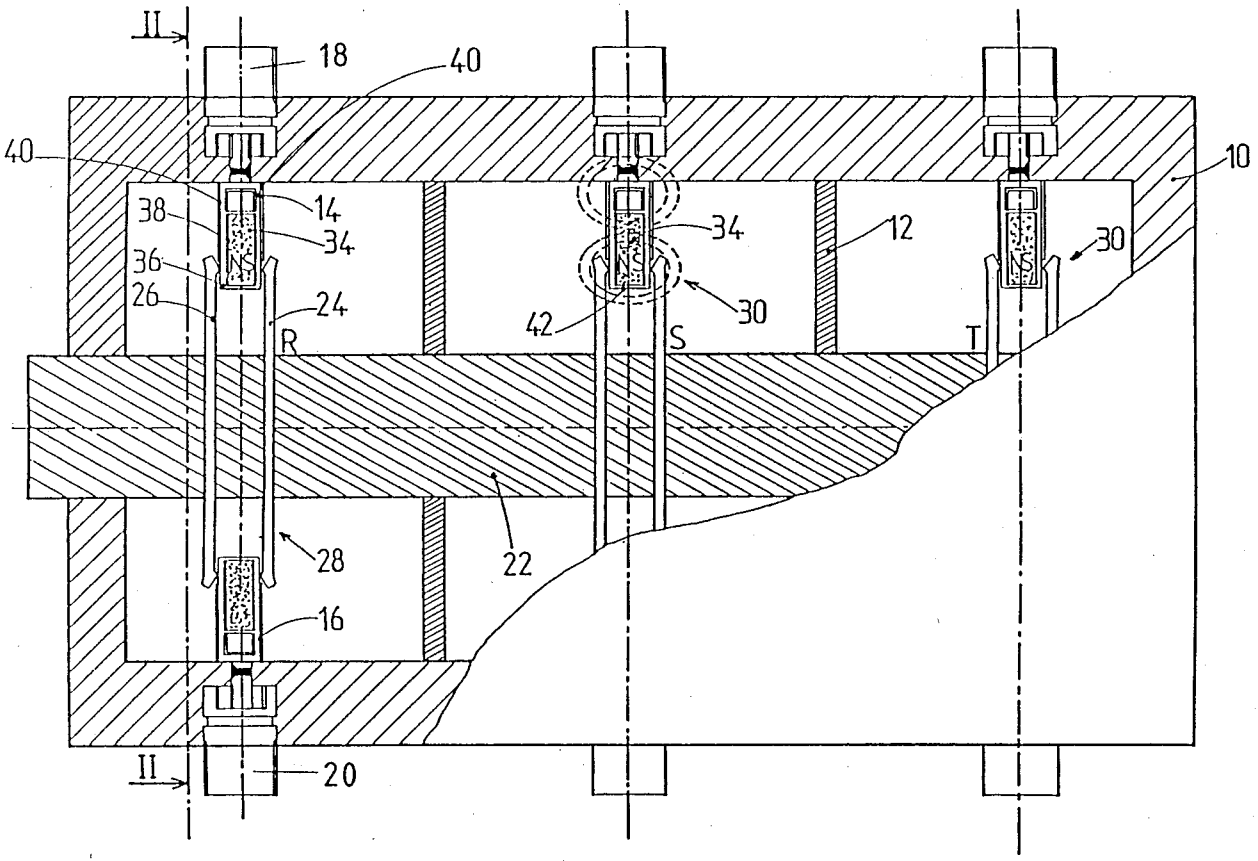
FIG. 1 is a schematic partial cross-sectional view of a multipole switch according to the invention.

In the figures, a medium voltage rotary switch comprises a sealed enclosure 10 housing the three poles R, S, T of the switch. The enclosure 10 may be common to the three poles R, S, T, and be made of metal or of insulating material. It can also be formed by associating three modules, each assigned to one of the poles or be a single enclosure 10 subdivided into three compartments by internal partitions 12, as represented in FIG. 1. The three poles R, S, T are identical and only one of them will be described in detail hereinafter. The sealed enclosure 10 is filled with a high dielectric strength gas such as sulphur hexafluoride at atmospheric pressure or at overpressure.

Each pole comprises two stationary contacts 14, 16 disposed on the internal periphery of the enclosure 10 at diametrically opposed points and each stationary contact 14, 16 is extended by a sealed bushing 18, 20 of the enclosure 10. The movable assembly of the switch is formed by an operating shaft 22, supporting a rotary knife-blade 28 made up of two contact blades 24, 26 whose opposite ends 30, 32 form movable contact grips cooperating with the stationary contacts 14, 16. In the closed position of the switch, represented in FIG. 2, the knife-blade 28 electrically connects the stationary contacts 14, 16 and opening of the switch is achieved by a counterclockwise rotation of the shaft 22. The two stationary contacts 14, 16 are identical and each one is arranged in the form of a cylindrical stud whose axis is parallel to the shaft 22. Inside the cylindrical stud 14, 16 there is housed a permanent magnet 34 surrounded by a cylindrical-shaped conducting sheath 36. Steel disks 38 of small thickness are fitted between the polar faces of the axial magnetization permanent magnet 34 and the sheath 36. In the closed position the movable contact grip 30, 32 grips the lower periphery of the cylindrical contact stud 14, 16, the contact blades 24, 26 being in contact with the lateral sections of this stud. The axial dimension of the cylindrical stud 14, 16 is slightly greater than the separation of the grips formed by the blades 24, 26 to obtain sufficient contact pressure. The upper part of the lateral sections of the contact 14, 16 is coated with insulating material 40 preventing the arc from migrating onto this part.

The field lines of the permanent magnet 34 are represented by the broken line on pole S of FIG. 1 and it can be seen that these lines extend parallel to the cylindrical periphery 42 of the contact stud 14, 16. This periphery 42 constitutes a migration track of the arc root anchored on this contact 14, 16. In the closed position of the switch, represented in FIG. 2, the current flows via the sheath 36 of the contact stud 14, 16 outside the permanent magnet 34 without the risk of demagnetizing the latter. When opening takes place by rotation of the shaft 22, the knife-blade 28 separates from the stationary contacts 14, 16, and two arcs 44, 46 electrically connected in series, are drawn respectively between the stationary contact 14 and the knife-blade 28, and between the latter and the stationary contact 16. Due to the action of the magnetic field of the permanent magnet 34, the arc roots 48, 50 anchored on the stationary contacts 14, 16 are blown and they migrate on the cylindrical periphery 42 forming an arc root migration track. The rotation direction of the arc root 48, 50 is determined by the polarity of the alternating current at the moment breaking takes place, and in FIG. 3 it can be seen that the two arc roots 48, 50 are blown to a hidden location diametrically opposite from the arc formation point facing the knife-blade 28. The hot spots associated with the arc roots 48, 50 are thus removed to hidden locations 52, 54 and when the arcs 44, 46 are extinguished naturally, when passing zero current, the optimum non-refiring conditions are met. Indeed, the thermoelectronic emission at the hot spot 52, 54 does not take place opposite the knife-blade 28, which prevents or limits the risks of refiring of the arcs 44, 46 when the recovery voltage appears. Migration of the arc roots 48, 50 naturally participates in lengthening the arc and in moving it in the gaseous insulating medium to favor current breaking in the usual way. It can be seen in FIG. 3 that, when the current polarity is the reverse at the moment the arcs 44, 46 form, the arc roots 48, 50 rotate in the opposite direction to come towards the bushings 18, 20 at locations less far away and hidden from the knife-blade 28 than the hidden locations 52, 54. If breaking of the current does not take place the first time the current passes zero, it is necessary to wait until the end of the next half-wave when the optimum conditions of presence of the hot spots at the hidden locations 52, 54 are again found. Certain particular arrangements described hereinafter avoid this dissymetry.

In the following figures, which illustrate various alternative embodiments, the same reference numbers designate similar or identical parts to those in FIGS. 1 to 3.

Figures 4, 5:
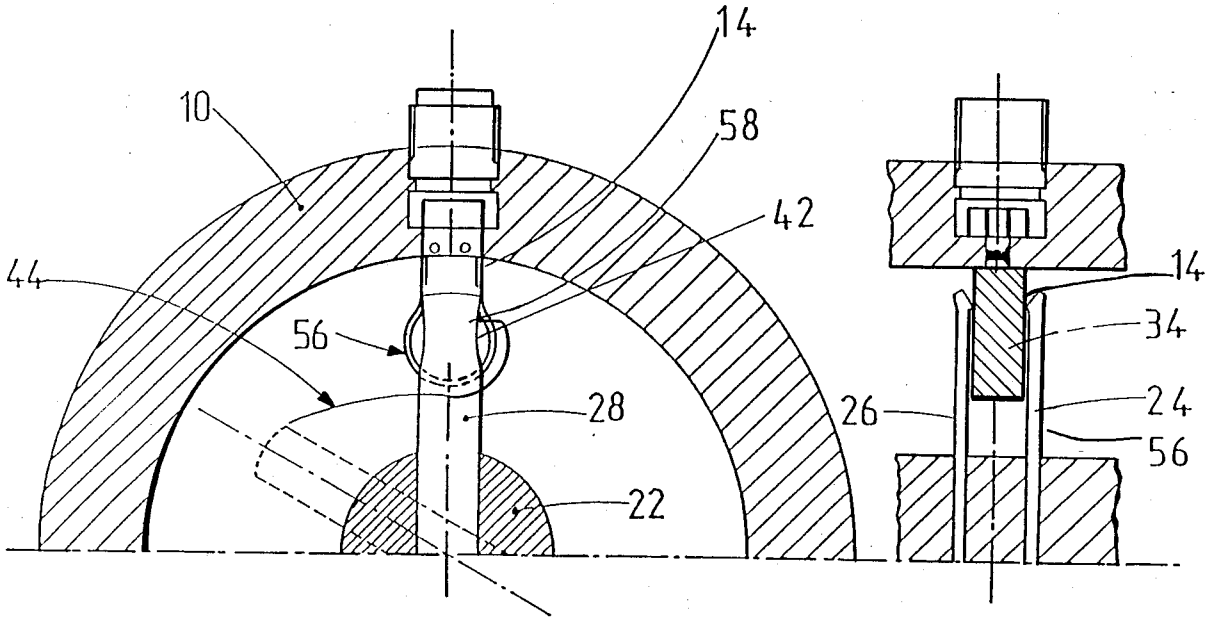
FIG. 4 is a semi cross-section illustrating an alternative embodiment according to the invention.
FIG. 5 is a sectional side view of the switch according to FIG. 4.

Referring now to FIGS. 4 and 5, an alternative embodiment can be seen wherein the stationary contact 14 comprises an insulating coating in particular of epoxy resin 56 covering the cylindrical surface of the contact stud 14. The flat sections or surfaces of the contact stud 14 are on the other hand bare and they constitute the arc root contact and migration surfaces. Operation of the switch is not affected by this modification, the arc root anchored on the stationary contact 14 being blown by the magnetic field of the permanent magnet along the periphery of the lateral section or sections of the contact stud 14 to a hidden point 58 which is not facing the knife-blade of the movable contact 28. In this alternative embodiment, it is advantageous to use a permanent magnet 34 with radial magnetization. The contact blades 24, 26 have been extended to move the contact point in the direction of the enclosure 10 and to move the current path away from the magnet 34 thus limiting demagnetization risks. This particular feature can be used on the other embodiments described.

Figure 6:
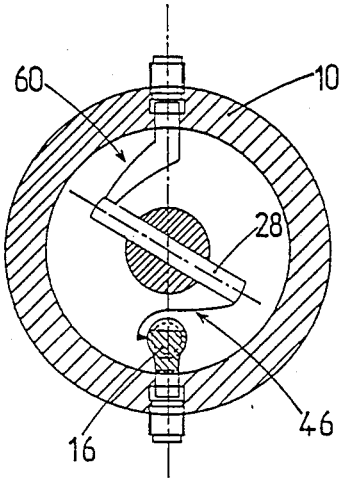
FIGS. 6 to 11 to similar views to FIG. 2, illustrating various alternative embodiments according to the invention.

In the switch according to FIG. 6, the pair of contacts 14, 28 is replaced by a sliding contact 60. Rotation of the knife-blade 28 in the opening direction causes a single arc 46 to occur which is extinguished in the manner described above by migration of the arc root to a hidden location. Inserting a single arc in the circuit to be interrupted limits the breaking capacity of the switch but makes the latter easier to achieve.

Figure 2:
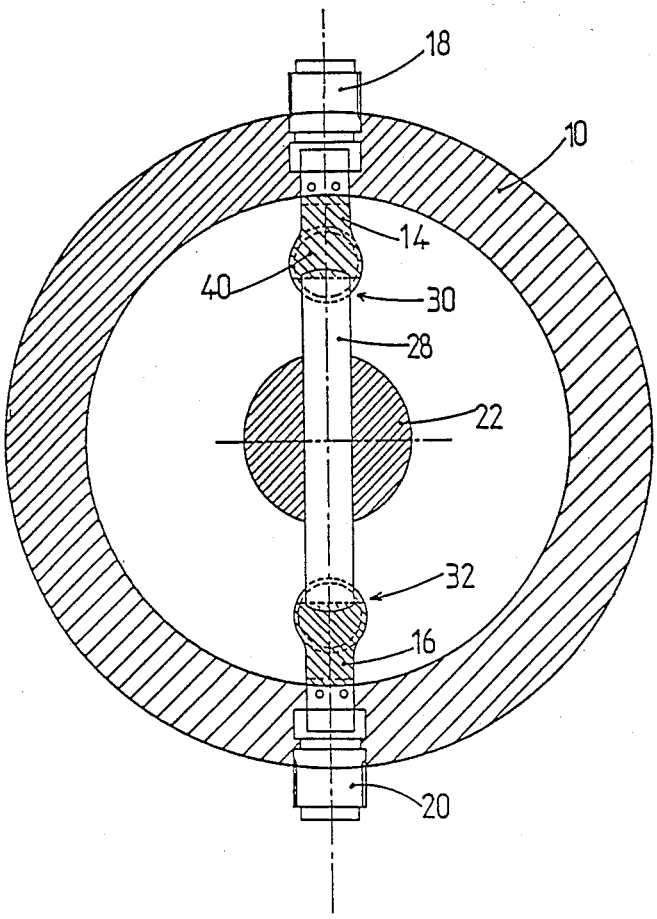
FIG. 2 is a cross-section along the line II—II of FIG. 1 representing the switch in the closed position.
Figure 3:
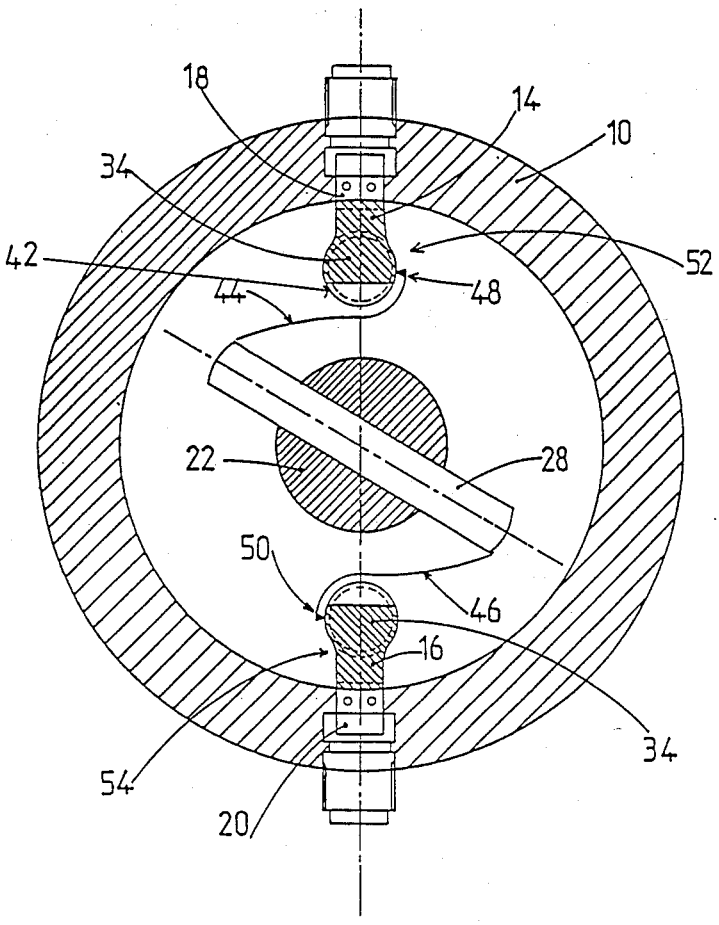
FIG. 3 is a similar view to that of FIG. 2 showing the switch in the course of opening.
Figure 7:
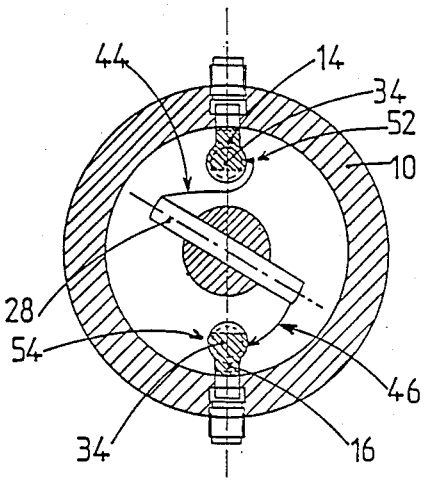

The polarity of the permanent magnets 34 determines the rotation direction of the arcs 44, 46 and in the example described in reference to FIGS. 1 to 3, current extinction and breaking are enhanced for one of the alternating current half-waves. In the embodiment represented in FIG. 7, a dissymetry between the contacts 14, 16 is introduced by choosing reverse polarities of the magnets 34 associated with these contacts 14, 16 in such a way that if one of the arcs, for example the arc 44 is blown towards the hidden location 52, at a given moment the other arc 46 is blown towards the hidden location 54 at the next half-wave. Whatever the polarity of the half-wave at the moment the contacts 14, 16, 28 open, one of the arcs 44, 46 will be blown towards the hidden location enhancing extinction. Any delay in breaking the current is thus avoided but to the slight detriment of the extinction capacity of one of the arcs 44, 46.

Figure 8:
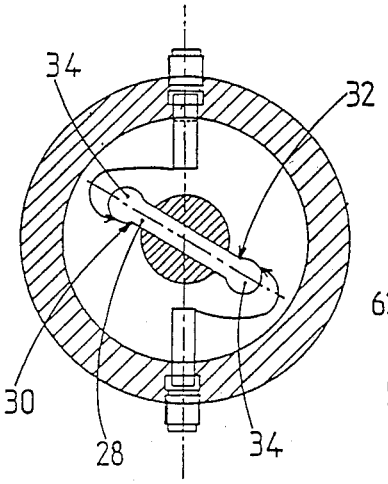
Figure 10:
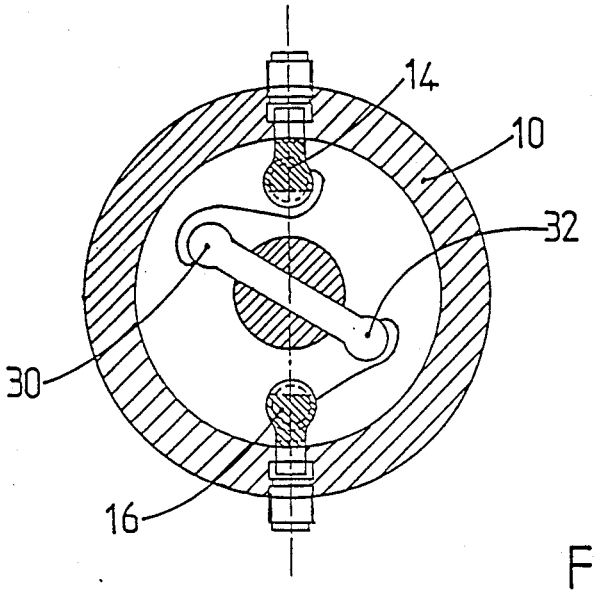

The arc root migration tracks are preferably associated with the stationary contacts 14, 16 in the manner described above, but it is clear that it would not depart from the spirit of the invention if these tracks were associated with the movable contacts 30, 32 supported by the knife-blade 28 (FIG. 8). The inertia of the movable assembly is increased by the presence of the permanent magnets 34 but the operation, notably the movement of the arc roots to hidden locations, which are not facing the opposite contact, remains fully conserved. Only one of the contacts 30, 32 can moreover be equipped with an arc migration track, the other contact being a standard contact or a contact having the migration track of the arc root associated with the stationary contacts. Any other combination is conceivable and more particularly the one represented in FIG. 10 wherein all the contacts 14, 16, 30, 32 are equipped with a migration track and an associated permanent magnet. The choice of the rotation direction of the arc roots is thus notably increased and this choice is made according to the performances required.

Figure 9:
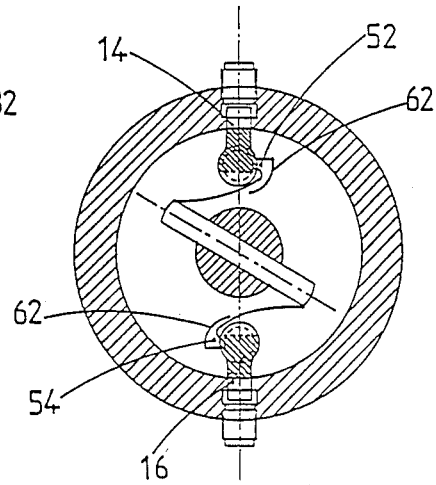
Figure 11:
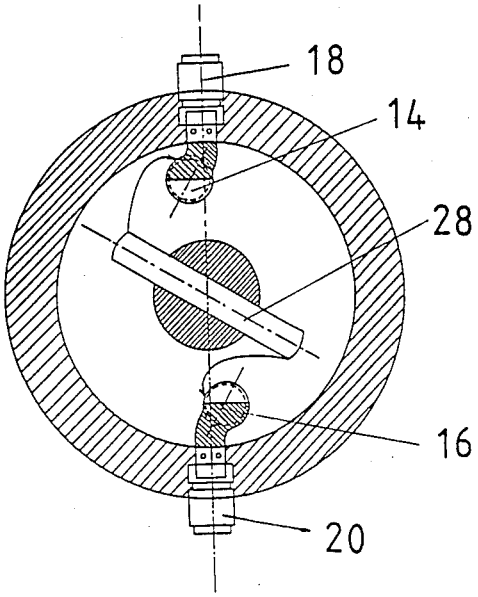

By avoiding according to the invention the hot spots being facing one another when breaking occurs, the risks of non-recovery are low but they can be further reduced by providing a confinement of these hot spots, according to a development of the invention. In the alternative embodiment illustrated by FIG. 9, whose general structure corresponds to that illustrated by FIGS. 2 and 3, a cover 62 surrounds the stationary contact studs 14, 16 in the vicinity of the hidden location 52, 54. The cover 62 defines a corridor of small width allowing the arc root to penetrate and to migrate to the hidden location 52, 54, while confining the electrons emitted by the hot spots in a space away from the contacts. -The cover 62 can enclose the stationary contact 14, 16 leaving only a slot through which the arc can penetrate, or this cover 62 can be formed by a simple shield disposed opposite the hot spots. It is clear from the above description that the rotational movement of the knife-blade 28 introduces a dissymmetry enhancing breaking for one of the current half-waves. By displacing the stationary contact studs 14, 16 with respect to the bushings 18, 20 as represented in FIG. 11, to arrange the separation points of the contacts 14, 28; 16, 28 and the current input points to the contact studs 14, 16 at diametrically opposed locations, this dissymmetry is avoided and the hidden points are reached whatever the current half-wave.

The invention is quite naturally applicable to other types of switches and more particularly to a switch having an enclosure 10 or housing of the modular type, or a metal housing. The switch may also comprise earthing contacts supported by the enclosure 10 and cooperating with the knife-blade 28 and the contacts 14, 16, 28 may be of the abutment type or of any other constitution.

We claim:

1. A medium voltage rotary switch comprising a sealed enclosure, having an internal periphery, two stationary contacts fixed at diametrically opposed points of said periphery, a contact bridge having ends arranged as movable contacts, each capable of cooperating with one of said stationary contacts to form a pair of contacts, a rotating operating shaft supporting said contact bridge, which can selectively occupy a closed position in which the two pairs of contacts are closed and an open position in which the two pairs of contacts are open, at least one of the contacts of one of said pairs comprising a migration track of the root of an arc drawn when the pair of contacts opens, said track extending in the opposite direction from the other contact of said one of said pairs, and having a hidden location to enable the arc root and the associated hot spot to move towards said hidden location where the two hot spots associated with the two arc roots are not facing and a permanent magnet, securedly fixed to the migration track contact, is arranged to blow the arc root towards said hidden location to favor arc extinction and current breaking.

2. The rotary switch according to claim 1, wherein said migration track describes a curved trajectory and wherein the permanent magnet is disposed inside said track with field lines arranged to move the arc root on said curved trajectory.

3. The rotary switch according to claim 2, wherein the migration track contact is in the form of a cylindrical stud whose axis is parallel to said rotating operating shaft and wherein said permanent magnet is cylindrical and housed inside said track constituted by a cylindrical conducting sheath forming the contact area.

4. The rotary switch according to claim 3, wherein said sheath comprises a cylindrical surface forming the migration track, which extends on the opposite side from the other contact of said pair, and flat surfaces at least partially covered by an insulating coating to prevent the arc firing on these flat surfaces.

5. The rotary switch according to claim 3, wherein said sheath comprises flat surfaces having a periphery forming the migration track, and a cylindrical surface at least partially covered by an insulating coating.

6. The rotary switch according to claim 1, wherein each pair of contacts comprises a contact equipped with a migration track and a permanent blowout magnet, the polarities of the magnets being such that the two arcs are blown simultaneously towards said hidden locations.

7. The rotary switch according to claim 1, wherein each pair of contacts comprises a contact equipped with a migration track and a permanent blowout magnet, the polarities of the magnets being such that the two arcs are blown simultaneously towards said hidden location.

8. The rotary switch according to claim 1, comprising a cover which caps the migration track in the area of said hidden location, leaving a corridor for the arc to penetrate and move to this hidden location.

9. The rotary switch according to claim 1, wherein each of said contacts is equipped with a migration track and a permanent magnet.

10. The rotary switch according to claim 1, wherein one of the contacts of a pair of contacts comprises a cylindrical permanent magnet whose axis is parallel to said rotating shaft and a cylindrical conducting sheath surrounding said cylindrical magnet and wherein the other contact of said pair comprises a contact grip which grips said cylindrical sheath on the two lateral faces in the closed position.

* * * * *